US011072990B2

(12) United States Patent
Yuan et al.

(10) Patent No.: US 11,072,990 B2
(45) Date of Patent: Jul. 27, 2021

(54) BUOYANCY ASSIST TOOL WITH OVERLAPPING MEMBRANES

(71) Applicant: Halliburton Energy Services, Inc., Houston, TX (US)

(72) Inventors: Min Mark Yuan, Katy, TX (US); Ishwar Dilip Patil, Spring, TX (US); Mayur Narain Ahuja, Friendswood, TX (US); Lonnie Carl Helms, Humble, TX (US); Clayton Reed Bonn, Alvin, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 39 days.

(21) Appl. No.: 16/663,935

(22) Filed: Oct. 25, 2019

(65) Prior Publication Data

US 2021/0123317 A1 Apr. 29, 2021

(51) Int. Cl.
*E21B 33/12* (2006.01)
*E21B 29/02* (2006.01)

(52) U.S. Cl.
CPC ..... *E21B 33/12* (2013.01); *E21B 29/02* (2013.01)

(58) Field of Classification Search
CPC ..... E21B 33/12; E21B 29/02
See application file for complete search history.

(56) References Cited

U.S. PATENT DOCUMENTS 3,463,351 A 8/1969 Mills
3,779,263 A 12/1973 Edwards et al.
3,980,134 A 9/1976 Amancharla
4,457,376 A 7/1984 Carmody et al.
5,150,756 A 9/1992 Hassanzadeh
5,479,986 A 1/1996 Gano et al.
5,765,641 A 6/1998 Shy et al.
5,826,661 A * 10/1998 Parker ..... E21B 23/00 166/386
6,026,903 A 2/2000 Shy et al.
6,076,600 A 6/2000 Vlck, Jr. et al.
6,161,622 A 12/2000 Robb et al.
6,324,904 B1 12/2001 Ishikawa et al.
6,450,263 B1 9/2002 Schwendemann
6,505,685 B1 1/2003 Sullaway et al.
6,622,798 B1 9/2003 Rogers et al.
(Continued)

FOREIGN PATENT DOCUMENTS

EP 0566290 A1 10/1993
EP 0681087 B1 9/2000
(Continued)

OTHER PUBLICATIONS

International Search Report and Written Opinion dated Jul. 21, 2020, issued in PCT Application No. PCT/US2019/059864.
(Continued)

*Primary Examiner* — Brad Harcourt
(74) *Attorney, Agent, or Firm* — McAfee & Taft

(57) ABSTRACT

A downhole apparatus has a casing string and a degradable plug positioned in the casing string to block flow therethrough. An upper membrane covers an upper end of the degradable plug. The upper membrane is made up of a plurality of separable membranes. A lower membrane covers a lower end of the degradable plug and is comprised of a plurality of separable membranes.

17 Claims, 4 Drawing Sheets

(56) References Cited

U.S. PATENT DOCUMENTS

| | | | | |
|---|---|---|---|---|
| 6,651,748 | B2 | 11/2003 | Sullaway et al. | |
| 6,672,389 | B1 | 1/2004 | Hinrichs | |
| 6,758,281 | B2 | 7/2004 | Sullaway et al. | |
| 7,270,191 | B2 | 9/2007 | Drummond et al. | |
| 8,505,621 | B2 | 8/2013 | Telfer et al. | |
| 9,033,055 | B2 * | 5/2015 | Mccoy | E21B 34/14 166/373 |
| 9,309,752 | B2 | 4/2016 | Talley et al. | |
| 9,441,437 | B2 | 9/2016 | Fripp et al. | |
| 9,441,446 | B2 | 9/2016 | Fripp et al. | |
| 9,518,445 | B2 | 12/2016 | Noske | |
| 9,540,904 | B2 | 1/2017 | Petrowsky | |
| 9,593,542 | B2 | 3/2017 | Getzlaf et al. | |
| 10,138,707 | B2 | 11/2018 | Tolman et al. | |
| 10,323,478 | B2 | 6/2019 | Berscheidt et al. | |
| 2002/0185273 | A1 | 12/2002 | Aronstam et al. | |
| 2003/0116324 | A1 | 6/2003 | Dawson et al. | |
| 2003/0217844 | A1 | 11/2003 | Moyes | |
| 2008/0073075 | A1 | 3/2008 | Buyers et al. | |
| 2008/0115942 | A1 | 5/2008 | Keller et al. | |
| 2010/0270031 | A1 | 10/2010 | Patel | |
| 2010/0294376 | A1 | 11/2010 | O'Brien et al. | |
| 2011/0042099 | A1 | 2/2011 | Williamson, Jr. et al. | |
| 2011/0253392 | A1 | 10/2011 | May et al. | |
| 2012/0111566 | A1 | 5/2012 | Sherman et al. | |
| 2014/0174757 | A1 | 6/2014 | Fripp et al. | |
| 2014/0216756 | A1 | 8/2014 | Getzlaf et al. | |
| 2014/0224505 | A1 | 8/2014 | Ramon | |
| 2014/0338923 | A1 | 11/2014 | Fripp et al. | |
| 2015/0107843 | A1 | 4/2015 | Talley et al. | |
| 2015/0129205 | A1 | 5/2015 | Hofman et al. | |
| 2015/0240596 | A1 | 8/2015 | Horwell | |
| 2016/0177668 | A1 | 6/2016 | Watson et al. | |
| 2016/0333658 | A1 | 11/2016 | Keshishian et al. | |
| 2017/0096875 | A1 | 4/2017 | Ravensbergen et al. | |
| 2017/0138153 | A1 | 5/2017 | Getzlaf et al. | |
| 2018/0003004 | A1 | 1/2018 | Norman et al. | |
| 2018/0058179 | A1 | 3/2018 | Nuryaningsih et al. | |
| 2018/0080308 | A1 | 3/2018 | Dedman et al. | |
| 2018/0219200 | A1 | 8/2018 | Albukrek et al. | |
| 2018/0262127 | A1 | 9/2018 | Gooneratne et al. | |
| 2018/0371869 | A1 | 12/2018 | Kellner et al. | |
| 2019/0128081 | A1 | 5/2019 | Ross et al. | |
| 2019/0352994 | A1 | 11/2019 | Giroux | |
| 2019/0352995 | A1 | 11/2019 | Giroux et al. | |

FOREIGN PATENT DOCUMENTS

| | | | |
|---|---|---|---|
| JP | 6551001 | B2 | 7/2019 |
| WO | 2014098903 | A1 | 6/2014 |
| WO | 2015073001 | A1 | 5/2015 |
| WO | 2016176643 | A1 | 11/2016 |
| WO | 2019099046 | A1 | 5/2019 |

OTHER PUBLICATIONS

International Search Report and Written Opinion dated Jul. 23, 2020, issued in PCT Application No. PCT/US2019/061714.
International Search Report and Written Opinion dated Aug. 11, 2020, issued in PCT Application No. PCT/US2019/065862.
International Search Report and Written Opinion dated Aug. 31, 2020, issued in PCT Application No. PCT/US2020/012307.
International Search Report and Written Opinion dated Aug. 14, 2018, issued in PCT Application No. PCT/US2017/062528.
International Search Report and Written Opinion dated Sep. 19, 2019, issued in PCT Application No. PCT/US2018/066889.
International Search Report and Written Opinion dated Sep. 19, 2019, issued in PCT Application No. PCT/US2018/067161.
International Search Report and Written Opinion dated Aug. 14, 2019, issued in PCT Application No. PCT/US2019/064051.
International Search Report and Written Opinion dated Jan. 14, 2020, issued in PCT Application No. PCT/US2019/027502.
International Search Report and Written Opinion dated Feb. 5, 2020, issued in PCT Application No. PCT/US2019/0031541.
International Search Report and Written Opinion dated Jan. 21, 2020, issued in PCT Application No. PCT/US2019/028508.
International Search Report and Written Opinion dated May 25, 2020, issued in PCT Application No. PCT/US2019/056206.
International Search Report and Written Opinion dated May 26, 2020, issued in PCT Application No. PCT/US2019/059757.
International Search Report and Written Opinion dated Jan. 16, 2020, issued in PCT Application No. PCT/US2019/027625.
International Search Report and Written Opinion dated Oct. 27, 2020, issued in PCT Application No. PCT/US2020/039399.
International Search Report and Written Opinion dated Feb. 24, 2021, issued in PCT Application No. PCT/US2020/040157.

* cited by examiner

BUOYANCY ASSIST TOOL WITH OVERLAPPING MEMBRANES

BACKGROUND

The length of deviated or horizontal sections in well bores is such that it is sometimes difficult to run well casing to the desired depth due to high casing drag. Long lengths of casing create significant friction and thus problems in getting casing to the toe of the well bore. Creating a buoyant chamber in the casing utilizing air or a fluid lighter than the well bore fluid can reduce the drag making it easier to overcome the friction and run the casing to the desired final depth.

DESCRIPTION

Figure 1:
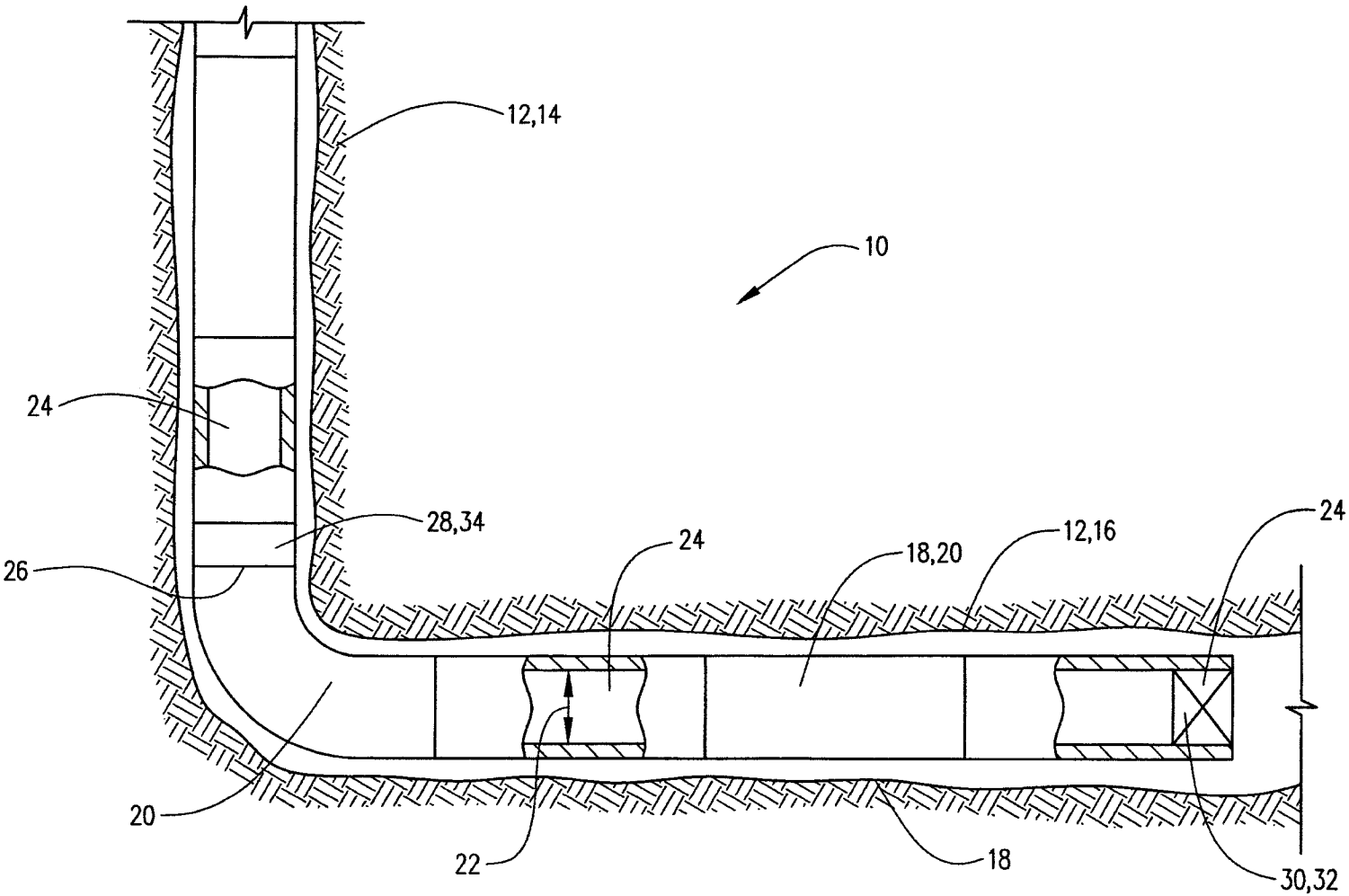
FIG. 1 is a schematic view of an exemplary well bore with a well casing including a buoyancy chamber therein.
Figure 2:
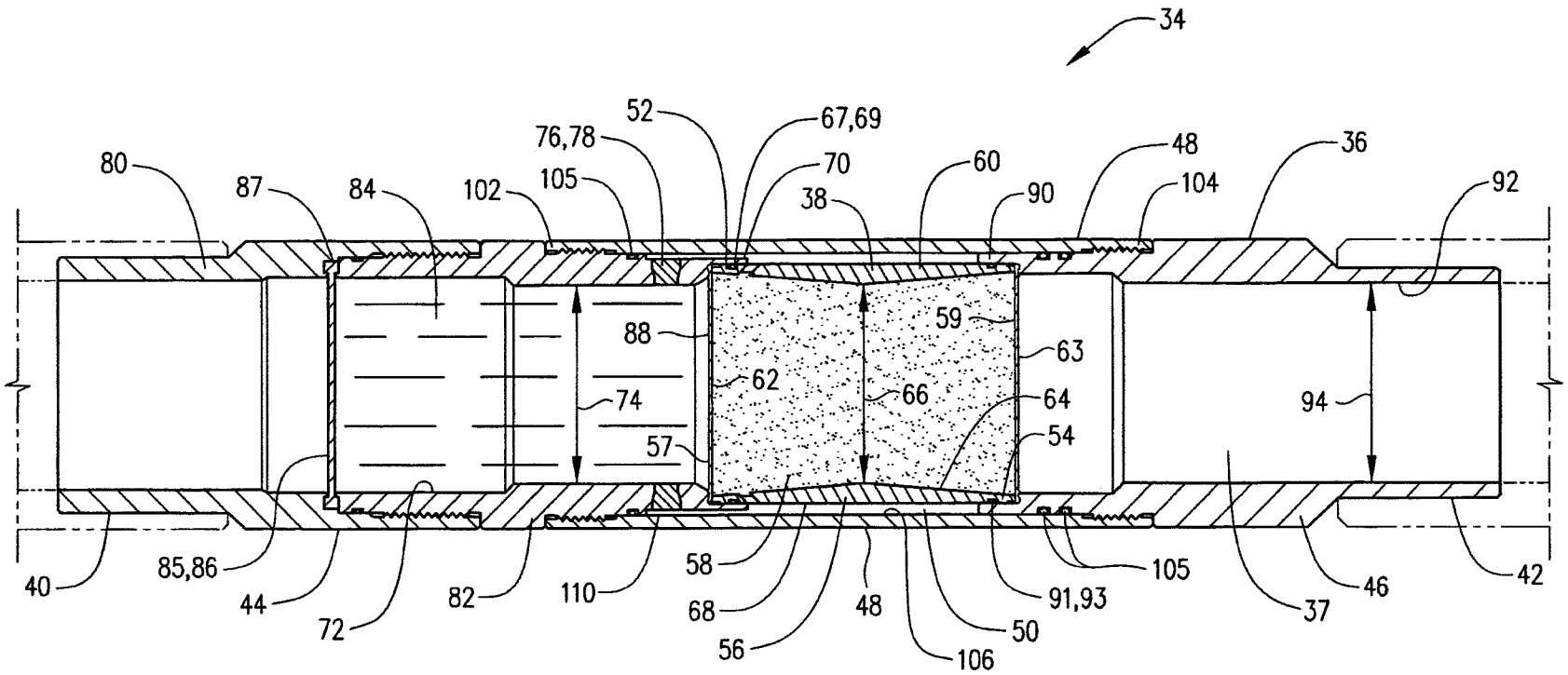
FIG. 2 is a cross section of a buoyancy assist tool of the current disclosure.
Figure 3:
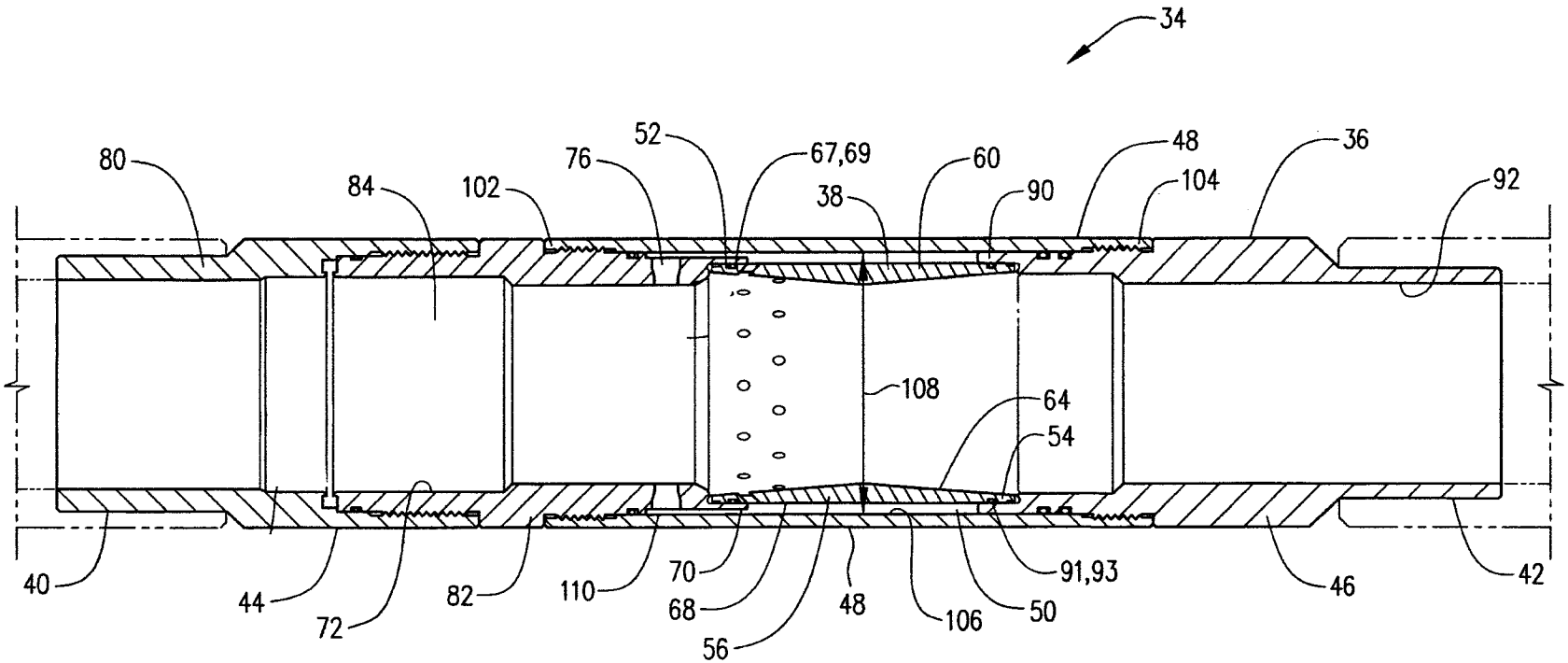
FIG. 3 is a cross section of a buoyancy assist tool of FIG. 2 after the plug has degraded and been removed from the buoyancy assist tool.
Figure 4:
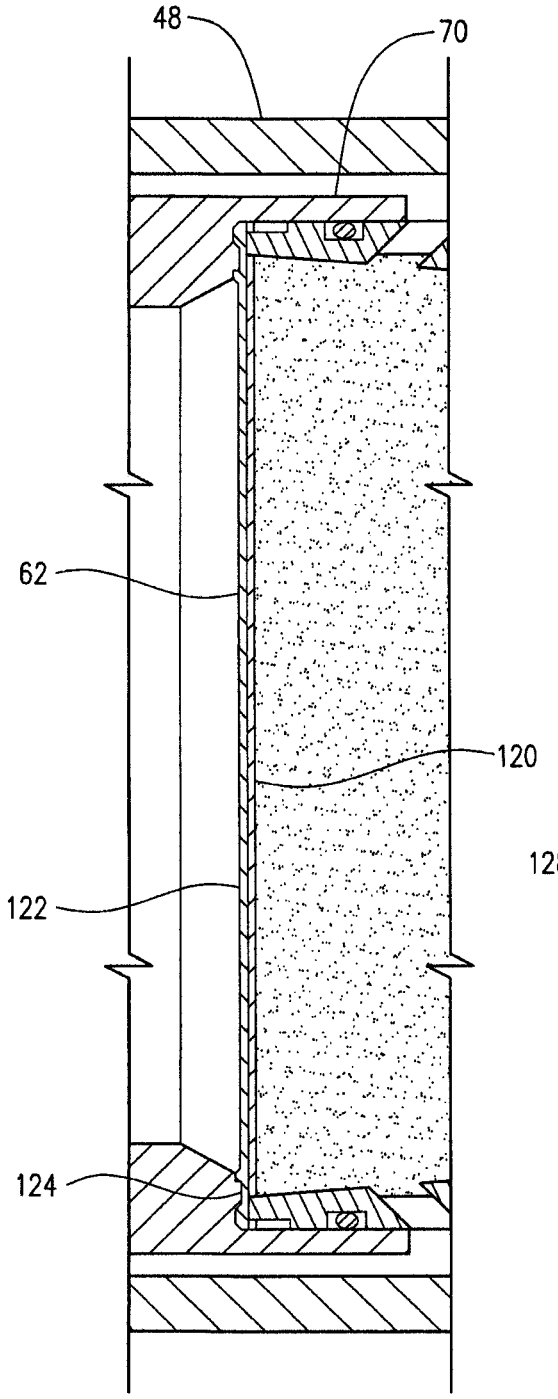
FIG. 4 is an enlarged view of the membrane covering an upper end of the degradable plug.
Figure 5:
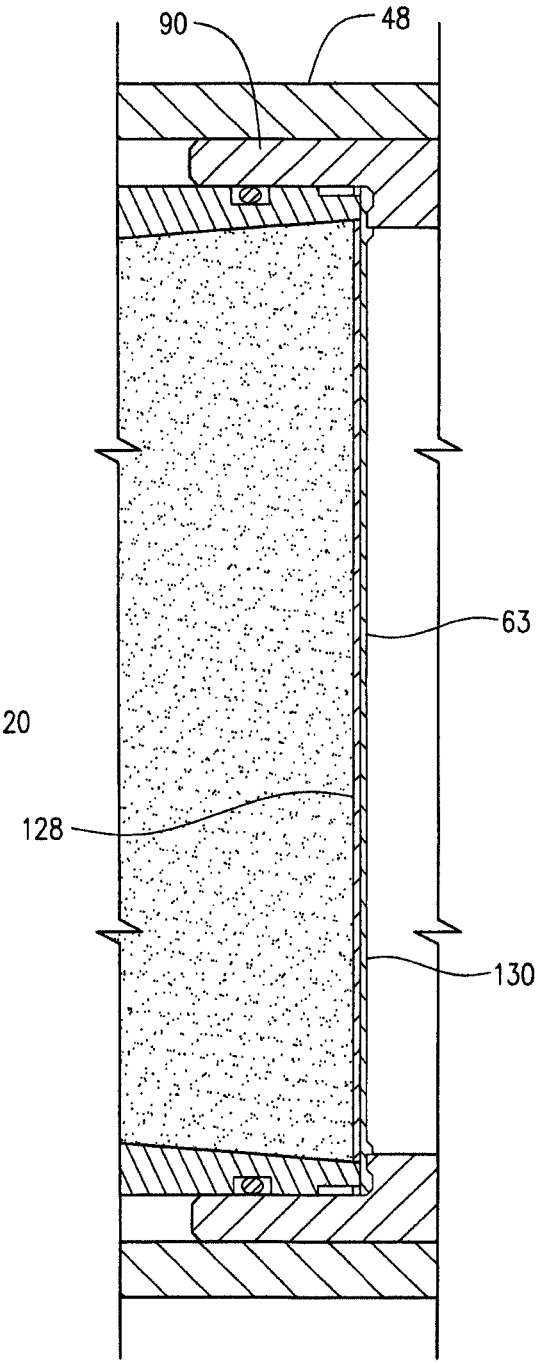
FIG. 5 is an enlarged view of the membrane covering a lower end of the degradable plug.

The following description and directional terms such as above, below, upper, lower, uphole, downhole, etc., are used for convenience in referring to the accompanying drawings. One who is skilled in the art will recognize that such directional language refers to locations in the well, either closer or farther from the wellhead and the various embodiments of the inventions described and disclosed here may be utilized in various orientations such as inclined, deviated, horizontal and vertical.

Referring to the drawings, a downhole apparatus 10 is positioned in a well bore 12. Well bore 12 includes a vertical portion 14 and a deviated or horizontal portion 16. Apparatus 10 comprises a casing string 18 which is made up of a plurality of casing joints 20. Casing joints 20 may have inner diameter or bore 22 which defines a central flow path 24 therethrough. Well casing 18 defines a buoyancy chamber 26 with upper end or boundary 28 and lower end or boundary 30. Buoyancy chamber 26 will be filled with a buoyant fluid which may be a gas such as nitrogen, carbon dioxide, or air but other gases may also be suitable. The buoyant fluid may also be a liquid such as water or diesel fuel or other like liquid. The important aspect is that the buoyant fluid has a lower specific gravity than the well fluid in the well bore 12 in which casing 18 is run. The choice of gas or liquid, and which one of these is used is a factor of the well conditions and the amount of buoyancy desired.

Lower boundary 30 may comprise a float device such as a float shoe or float collar 32. As is known, such float devices will generally allow fluid flow downwardly therethrough but will prevent flow upwardly into the casing. The float devices are generally a one-way check valve. The float device 32 is thus a fluid barrier that will be configured such that it will hold the buoyant fluid in the buoyancy chamber 26 until additional pressure is applied after the release of the buoyancy fluid from the buoyancy chamber. The upper boundary 28 is defined by a buoyancy assist tool as described herein.

Buoyancy assist tool 34 includes an outer case 36 defining flow path 37 therethrough that is connectable in casing string 18. Buoyancy assist tool 34 comprises a plug assembly 38 that is connected to and positioned in outer case 36. Buoyancy assist tool 34 has upper end 40 and lower end 42. Buoyancy assist tool 34 is connectable in the casing string at the upper and lower ends 40 and 42 thereof and forms a part of the casing string 18 lowered into well bore 12.

Outer case 36 comprises an upper outer case 44 and a lower outer case 46. A connecting shield 48 is connected to and extends between upper outer case 44 and lower outer case 46. Outer case 36 and plug assembly 38 define an annular space 50 therebetween.

Plug assembly 38 has upper end 52 and lower end 54. Plug assembly 38 is connected to upper outer case 44 at the upper end 52 thereof and to lower outer case 46 at the lower end 54 thereof. The plug assembly may be threadedly connected or connected by other means known in the art. Plug assembly 38 may comprise a plug housing 56 with upper and lower ends 52 and 54 which are the upper and lower ends of the plug assembly 38. A degradable plug or degradable core 58 is fixed in housing 56. Degradable core 58 has upper end 57 and lower end 59, which may be for example coincident with the upper and lower ends 52 and 54 of plug housing 56. The degradable core may be a matrix of sand and salt but can be other degradable substances that can be degraded with fluids or other means once the casing string 18 is lowered into the well bore to a desired location in the well. Plug housing 56 has a plurality of housing ports 60 defined through the wall thereof. Housing ports 60 communicate the annular space 50 with the degradable plug or core 58 so that fluid passing therethrough can contact degradable plug 58 and can degrade the plug to remove it from plug housing 56 to create a full bore flow path therethrough.

Buoyancy assist tool 34 may include an upper impermeable membrane 62 positioned across upper end 57 of degradable plug 58 and a lower impermeable membrane 63 positioned across the lower end 59 of degradable plug 58. Impermeable membranes 62 and 63, as described in more detail below, comprise a plurality of separable membranes configured to prevent the premature contact of fluid with degradable plug 58. Membranes 62 and 63 will prevent fluid thereabove from contacting the degradable plug at the upper end of the plug assembly 38 prior to the time casing string 18 is placed at the desired location in well bore 12. Likewise, the impermeable membrane 63 will prevent fluid in the buoyancy chamber 26 from contacting the degradable plug 58 until such time as degradation of the plug is desired. Upon degradation of the plug 58 the membranes 62 and 63 will be easily ruptured by fluid flowing through the casing string 18, including outer case 36.

Plug housing 56 has an inner surface 64 defining a diameter 66 and has an outer surface 68. In the embodiment described diameter 66 is a diameter that is no smaller than an inner diameter of casing string 18 such that upon the degradation of plug 58 buoyancy assist tool 34 provides no greater restriction to the passage of well tools therethrough than that which already exists as a result of the inner diameter of the casing string 18.

Upper end 40 of buoyancy assist tool 34 is likewise the upper end of upper outer case 44. Upper outer case 44 has a lower end 70. Plug assembly 38 is connected at its upper end 52 to the lower end 70 of upper outer case 44. Outer surface 68 of plug housing 56 may have a groove 67 with an O-ring seal 69 therein to sealingly engage an inner surface of upper outer case 44. Upper outer case 44 has inner surface 72 which defines an inner diameter 74 that is a minimum inner diameter of upper outer case 44. Upper outer case 44 has a port 76 therethrough. Inner diameter 74 is a diameter that is no smaller than an inner diameter of casing string 18 such that upon the degradation of plug 58 buoyancy assist tool 34 provides no greater restriction to the passage of well tools therethrough than that which already exists as a result of the inner diameter of the casing string 18.

A rupture disc or other rupturable membrane 78 is positioned in port 76 in upper outer case 44. Rupture disc 78 will prevent flow through port 76 until a desired or predetermined pressure is reached in casing string 18. Upon reaching the predetermined pressure the rupture disc 78 will rupture and fluid will be communicated from casing string 18 through port 76 into annular space 50. Fluid will pass from annular space 50 through housing ports 60 and will contact the degradable plug 58. The fluid passing therethrough may be referred to as a degrading fluid. The degrading fluid may be any fluid utilized to degrade the degradable plug and may be water or other degrading fluid.

The degrading fluid is in fluid chamber 84, which has upper end 86 and lower end 88. Upper membrane 62 prevents the fluid in fluid chamber 84 from contacting degradable plug 58 prior to the rupturing of rupture disc 78. Upper outer case 44 may be a two-piece outer case comprising an upper portion 80 that is threadedly and sealingly connected to lower portion 82. Lower portion 82 connects to plug assembly 38 as shown in the figures. Upper outer case 44 may define fluid chamber 84 which is a closed fluid chamber 84. Fluid chamber 84 has an upper seal 85 that extends across upper end 88 thereof. Fluid in fluid chamber 84 is thus trapped between seal 85 and the upper membrane 62. There are certain formations in which it is not desirable to pump water. In those instances oil or another fluid other than water may be utilized to fracture or otherwise treat the formation. Where, for example, water is the degrading fluid, but not the treatment fluid, water will be contained in the fluid chamber 84 such that upon reaching the appropriate position in the well oil or other fluid may be pumped through the casing string 18 so that the water in fluid chamber 84 will contact the degradable plug 58 a further described herein. The water in fluid chamber 84 passes into and from annular space 50 through ports 60 in plug housing 56 and will contact the degradable plug 58 until it is degraded or dissolved.

Lower outer case 46 has upper end 90 and a lower end which is the lower end 42 of buoyancy assist tool 34. Upper end 90 of lower outer case 46 is connected to lower end 54 of plug assembly 38. Outer surface 68 of plug housing 56 may have a groove 91 with an O-ring seal 93 therein to sealingly engage lower outer case 46. Lower outer case 46 has inner surface 92 defining an inner diameter 94. Inner diameter 94 is a diameter that is no smaller than an inner diameter of casing string 18 such that upon the degradation of plug 58 buoyancy assist tool 34 provides no greater restriction to the passage of well tools therethrough than that which already exists as a result of the inner diameter of the casing string 18.

Connecting sleeve 48 has upper end 102 and lower end 104. Connecting sleeve 48 is connected at its upper end 102 to an outer surface of upper outer case 44 and is connected at its lower end 104 to an outer surface of lower outer case 46. O-ring seals 105 may be positioned in grooves in the outer surfaces of the upper and lower outer cases 44 and 46 respectively to sealingly engage an inner surface 106 of connecting shield 48. Inner surface 106 of connecting shield 48 defines an inner diameter 108. An annular passageway 110 is defined by and between upper outer case 44 and connecting shield 48. Annular passageway 110 communicates fluid delivered through port 76 into annular space 50. Fluid is communicated through ports 60 so that it will contact degradable plug 58 to dissolve or degrade the plug.

Upper and lower membranes 62 and 63 may be multiple layer membranes in which at least some of the multiple layers are dissimilar materials. In the embodiment described the multiple layer membrane 62 covers the upper end 57 of degradable plug 58 and has a first or inner membrane 120 adjacent upper end 57 of the degradable core 58. Inner membrane 120 will cover the upper end of the degradable core 58. Multiple layer membrane 62 likewise includes a second or outer member adjacent to and covering the first inner membrane 120. First and second membranes 120 and 122 are of dissimilar materials and are not bonded to one another in any way. First and second membranes 120 and 122 are thus separable membranes. Thus, upon degradation of the plug 58 first and second membranes 120 and 122 will not adhere to one another and will break into pieces that will pass through casing string 18 and eventually through float equipment 32 at the end thereof. Outer membrane 122 is bonded to the upper end 52 of plug housing 56. In the embodiment described the inner membrane 120 is a membrane of a first material which may be, for example a silicone membrane and the outer membrane 122 is a membrane of a second material, which may be, for example, a nitrile rubber membrane. Utilizing a multiple layer membrane as described herein will alleviate the risk of a premature rupture of membrane. When a nitrile rubber membrane is directly in contract with the degradable core, it is possible that imperfections and rough areas in the degradable core could puncture the nitrile rubber and allow degrading fluid to contact and begin to prematurely degrade the core 58. Silicone inner membrane 120 described herein is far less likely to rupture and will provide separation between the upper end 57 of degradable core 58 and the nitrile rubber membrane.

Membrane 63 is generally identical to membrane 62 and multiple layer 63 membrane acts in the same way as does membrane 62. Thus, multiple layer membrane 63 covers the lower end 59 of the degradable core 58. First or inner membrane 128 of lower membrane 63 is adjacent lower end 59 and second or outer member 130 is adjacent first inner membrane 128 and covers membrane 128. Outer membrane 130 is bonded to the lower end 54 of plug housing 56. First and second membranes 128 and 130 are not bonded to one another and are separable membranes. Multiple layer membrane 63 will prevent the premature contact of any fluid in buoyancy chamber 26 from contacting and prematurely beginning to degrade plug core 58. First membrane 128 may be a silicone membrane and second membrane 130 may be a nitrile rubber membrane. The first and second membranes of multiple layer membranes 62 and 63 are not connected to one another in any way and are not bonded so that upon degradation of the degradable plug 58 both will tear into pieces small enough to pass through the casing 18 such that no restriction to any flow therethrough or to the passage of tools therethrough is provided.

In operation casing string 18 is lowered into well bore 12 to a desired location. Running a casing such as casing 18 in deviated wells and long horizontal wells often results in significantly increased drag forces and may cause a casing string to become stuck before reaching the desired location in the well bore. For example, when the casing produces more drag forces than the available weight to slide the casing down the well, the casing may become stuck. If too much force is applied to the casing string 18 damage may occur.

The buoyancy assist tool 34 as described herein alleviates some of the issues and at the same time provides for a full bore passageway so that other tools or objects such as, for example production packers, perforating guns and service tools may pass therethrough without obstruction after well casing 18 has reached the desired depth. When well casing 18 is lowered into well bore 12 buoyancy chamber 26 will aid in the proper placement since it will reduce friction as the casing 18 is lowered into horizontal portion 16 to the desired location.

Once the casing string 18 has reached the desired position in the well bore, pressure is increased and fluid pumped through the casing string 18. The pressure will burst the seal 85 and will push the degradable fluid contained in fluid chamber 84. Pressure will be increased until the rupture disc 78 bursts. Once that occurs degrading fluid from fluid chamber 84 will pass through port 76 into passageway 110 and into annular space 50. Fluid will pass from annular space 50 through ports 60 and will contact the degradable plug 58. A sufficient quantity of the degrading fluid will be utilized to degrade degradable plug 58 so that it will be completely removed from plug housing 56. Typically, once the degradation process reaches a certain level, the degradable plug 58 will break up, and at that point both of upper and lower membranes 62 and 63 will likewise be broken, and the pieces thereof will pass through casing string 18.

The choice of degrading fluid will be dependent on the plug material, but in many cases water will be used to degrade a plug formed of a sand and salt matrix. Once the degradable plug 58 is dissolved or degraded service tools may be passed through plug assembly 38, and more particularly through plug housing 56. As described herein, buoyancy assist tool 34 provides no size restriction on the tools that can be passed therethrough that does not already exist due to the size of the inner diameter of casing 18. In other words, diameters 66, 74 and 94 are of a size that will not limit the passage of tools beyond the limitation that results from the casing inner diameter thereabove.

A downhole apparatus comprises a casing string. A degradable plug is positioned in the casing string to block flow therethrough. An upper membrane covers an upper end of the degradable plug. The upper membrane comprises a plurality of separable membranes. In one embodiment a lower membrane covers a lower end of the degradable plug. The lower membrane may also comprise a plurality of separable membranes. A flexible fluid barrier is positioned in the casing string above the upper end of the degradable plug. The fluid barrier and the upper end of the degradable plug define a fluid chamber containing a degrading fluid. In one embodiment upper and lower membranes of the downhole apparatus the upper and lower membranes comprise a first membrane of a first material and a second membrane of a second material. The first membrane of the upper and lower membranes is positioned adjacent the upper and lower ends of the degradable plug and the second membrane covers the first membrane. The upper and lower membranes are configured to separate and tear upon degradation of the degradable plug. In one embodiment an outer case is connected in the casing string, and the fluid chamber is defined in the outer case. A plug housing is connected in the outer case, and the outer case and plug housing define an annular space therebetween. The plug housing has a plurality of ports communicating the annular space with the degradable plug. A rupture disk is positioned in a port in the outer case and configured to burst at a predetermined pressure. The port in the outer case is positioned to communicate fluid in the fluid chamber with the annular space. In one embodiment the membranes in the upper and lower membranes comprise a silicone membrane adjacent the upper and lower ends of the degradable plug and a rubber membrane covering the silicone membrane.

A downhole apparatus comprises an outer case connected at upper and lower ends in a casing string. A degradable plug is positioned in the outer case to block flow therethrough. An upper multiple layer impermeable membrane is positioned across an upper end of the degradable plug, and a lower multiple layer impermeable membrane is positioned across a lower end of the degradable plug. The upper and lower membranes each comprise membranes of dissimilar materials. The upper and lower multiple layer membranes comprise a first membrane adjacent the degradable plug and a second membrane covering the first membrane and the first and second membranes are not bonded to one another.

In one embodiment the upper and lower multiple layer membranes comprise a silicone membrane adjacent the upper and lower ends respectively of the degradable plug and a rubber layer covering the silicone layer. A flow barrier is connected in the casing string, and the flow barrier and degradable plug define a buoyancy chamber therebetween. A fluid chamber containing a degrading fluid is defined in the casing above the degradable plug. The degrading fluid in an embodiment comprises water, and an outer layer of the multiple layer membranes comprises a rubber membrane.

A downhole apparatus comprises a casing string lowered in a well. A buoyancy assist toll is connected in the casing string. A flow barrier is connected in the casing string and the buoyancy assist tool and the flow barrier define a buoyancy chamber therebetween. The buoyancy assist tool in one embodiment comprises an outer case with a plug housing positioned in the outer case. A degradable plug is fixed in the plug housing and an upper multiple layer impermeable membrane covers an upper end of the degradable plug. At least some layers of the upper multiple layer membrane comprise dissimilar materials. A fluid barrier in the casing positioned above the degradable plug barrier and the multiple layer membrane define a fluid chamber continuing a degrading fluid. A lower multiple layer impermeable membrane covers a lower end of the degradable plug, at least some of the layers of the lower multiple layer impermeable membrane comprising dissimilar materials. The upper multiple layer impermeable membrane comprises in one embodiment a first membrane adjacent the upper end of the degradable plug and a second membrane adjacent the first membrane. The first and second membranes are not bonded to one another and the second membrane is being bonded to the plug housing. The first membrane comprises a silicone membrane and the second membrane a nitrile rubber membrane.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. A downhole apparatus comprising:

a casing string;

a degradable plug positioned in the casing string to block flow therethrough;

an upper membrane covering an upper end of the degradable plug, the upper membrane comprising a plurality of flexible, separable membranes; and a flexible fluid barrier positioned in the casing string above the upper end of the degradable plug, the fluid barrier and the upper end of the degradable plug defining a fluid chamber containing a degrading fluid.

2. The downhole apparatus of claim 1, further comprising a lower membrane covering a lower end of the degradable plug, the lower membrane comprising a plurality of separable membranes.

3. The downhole apparatus of claim 1, the upper and lower membranes comprising:

a first membrane of a first material; and a second membrane of a second material, the first membrane of the upper and lower membranes positioned adjacent the upper and lower ends of the degradable plug and the second membrane covering the first membrane.

4. The downhole apparatus of claim 1, the upper and lower membranes configured to separate and tear upon degradation of the degradable plug.

5. The downhole apparatus of claim 1, further comprising:

an outer case connected in the casing string, the fluid chamber defined in the outer case;

a plug housing connected in the outer case, the outer case and plug housing defining an annular space therebetween, the plug housing having a plurality of ports communicating the annular space with the degradable plug; and a rupture disk positioned in a port in the outer case and configured to burst at a predetermined pressure, the port in the outer case positioned to communicate fluid in the fluid chamber with the annular space.

6. The downhole apparatus of claim 5, the membranes in the upper and lower membranes comprising a silicone membrane adjacent the upper and lower ends of the degradable plug and a rubber membrane covering the silicone membrane.

7. A downhole apparatus comprising:

an outer case connected at upper and lower ends in a casing string;

a degradable plug positioned in the outer case to block flow therethrough;

an upper multiple layer impermeable membrane positioned across an upper end of the degradable plug;

a lower multiple layer impermeable membrane positioned across a lower end of the degradable plug, the upper and lower membranes each comprising flexible membranes of dissimilar materials; and a fluid chamber containing a degrading fluid defined in the casing above the degradable plug.

8. The downhole apparatus of claim 7, the upper and lower multiple layer membranes comprising a first membrane adjacent the degradable plug and a second membrane covering the first membrane.

9. The downhole apparatus of claim 8, wherein the first and second membranes are not bonded to one another.

10. The downhole apparatus of claim 9, the upper and lower multiple layer membranes comprising a silicone membrane adjacent the upper and lower ends respectively of the degradable plug and a rubber layer covering the silicone layer.

11. The downhole apparatus of claim 7 further comprising a flow barrier connected in the casing string, the flow barrier and degradable plug defining a buoyancy chamber therebetween.

12. The downhole apparatus of claim 7, the degrading fluid comprising water, an outer layer of the multiple layer membranes comprising a rubber membrane.

13. A downhole apparatus comprising:

a casing string lowered in a well;

a buoyancy assist tool connected in the casing string;

a flow barrier connected in the casing string, the buoyancy assist tool and the flow barrier defining a buoyancy chamber therebetween the buoyancy assist tool comprising:

an outer case;

a plug housing positioned in the outer case;

a degradable plug fixed in the plug housing;

an upper multiple layer flexible impermeable membrane covering an upper end of the degradable plug, at least some layers of the upper multiple layer membrane comprising dissimilar materials; and a fluid barrier in the casing positioned above the degradable plug, the fluid barrier and the multiple layer flexible membrane defining a fluid chamber containing a degrading fluid.

14. The downhole apparatus of claim 13 further comprising a lower multiple layer impermeable membrane covering a lower end of the degradable plug, at least some of the layers of the lower multiple layer impermeable membrane comprising dissimilar materials.

15. The downhole apparatus of claim 13, the upper multiple layer impermeable membrane comprising:

a first membrane adjacent the upper end of the degradable plug; and a second membrane adjacent the first membrane, wherein the first and second membranes are not bonded to one another.

16. The downhole apparatus of claim 15, the second membrane being bonded to the plug housing.

17. The downhole apparatus of claim 15, the first membrane comprising a silicone membrane and the second membrane comprising a nitrile rubber membrane.

* * * * *